US006422804B1

(12) United States Patent
Gitter

(10) Patent No.: US 6,422,804 B1
(45) Date of Patent: Jul. 23, 2002

(54) INERTIA LOAD DAMPENING HYDRAULIC SYSTEM

(75) Inventor: Richard John Gitter, Peosta, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 09/507,350

(22) Filed: Feb. 18, 2000

(51) Int. Cl.[7] ..... B66C 23/00
(52) U.S. Cl. ..... 414/695.5; 91/461
(58) Field of Search ..... 414/694, 695.5; 91/441, 461

(56) References Cited

U.S. PATENT DOCUMENTS 3,815,766 A * 6/1974 Carlson et al. ..... 414/695.5
4,344,733 A * 8/1982 Hirsch ..... 414/695.5 X
4,419,640 A * 12/1983 Pedersen et al. ..... 414/695.5 X

FOREIGN PATENT DOCUMENTS

EP 0063025 * 10/1982 ..... 91/461

OTHER PUBLICATIONS

Ideas & Applications, Hydraulics & Pneumatics, p14, May 1985.*
Quick Reference Guide excerpted from Hydraulics brochure.
Deere & Company Fundamentals of Service Hydraulics Booklet, cover and pp. ii, 1–5 thru 1–11; 3–2 through 3–4, printed in the U.S.A., 1979.
John Deere Brochure 210C/310C, printed in the U.S.A., 1986.

* cited by examiner

*Primary Examiner*—Donald W. Underwood

(57) ABSTRACT

A hydraulic system is provided with a pump supplying pressurized hydraulic fluid through a first supply line to a closed center control valve. From the control valve the fluid is directed through work lines to a hydraulic motor. Exhausted hydraulic fluid from the hydraulic motor is directed through the control valve to an exhaust line having a back pressure check valve set at a first pressure level. The hydraulic motor is provided with a pressure relief valve and an anti-cavitation valve that are mounted in parallel with one another. The anti-cavitation valve is hydraulically coupled to the exhaust line. To keep the exhaust line fully charged a second supply line extends between the first supply line and the exhaust line. The second supply line is provided with a pressure reducing valve that is set at a second pressure level. The second pressure level of the pressure reducing valve is less than the first pressure level of the back pressure check valve.

16 Claims, 2 Drawing Sheets

INERTIA LOAD DAMPENING HYDRAULIC SYSTEM

BACKGROUND OF THE INVENTION

1. Field of the Invention

The invention is directed to an inertia load dampening hydraulic system wherein a second supply line keeps an exhaust line charged with pressurized hydraulic fluid.

2. Description of the Prior Art

Hydraulic motors in the form of linear hydraulic cylinders and rotary motors are used to move large bodies resulting in large inertial forces when the bodies are stopped. As the load is quickly stopped, oil on one side of the motor is forced over relief, and oil on the other side of the motor experiences cavitation. Fluid is directed to the cavitating side through anti-cavitation valves. In systems having closed center control valves there may be insufficient fluid to supply the cavitating side of the motor resulting in oscillation of the load as it is stopped.

One example of a machine that may experience this oscillation problem is a backhoe. A backhoe is provided with a pivotal boom which is attached to the vehicle by a swing frame. The swing frame is provided with a vertical pivot for pivoting the backhoe about a vertical axis relative to the vehicle. As the boom is quickly swung. and stopped the boom will oscillate . This oscillation is caused, by return fluid from the hydraulic swing cylinders being forced over the relief valves at high pressure as the closed center control valve closes. At the same time the supply side of the hydraulic swing cylinders experience a loss of fluid or cavitation. The high pressure developed on the return fluid side of the hydraulic swing cylinder now forces the boom back towards the cavitated side now building up pressure in that side. The newly generated pressure then pushes the hydraulic swing cylinders. This oscillating movement continues until the swing energy is dissipated and the boom oscillating motion stops.

SUMMARY

It is an object of the present invention to provide an inertial load hydraulic dampening system for dampening the high inertial forces generated by a body being driven by a hydraulic motor.

It is a feature of the invention that pressurized hydraulic fluid is directed to the exhaust line through a pressure reducing valve to assure that the anti-cavitation circuit of the hydraulic motor is adequately supplied.

The hydraulic circuit for this system is provided with a source of pressurized hydraulic fluid that is directed through a first supply line to a control valve. From the control valve the fluid is directed to work lines to a hydraulic motor. In the example explained in the description below, the hydraulic motor is two hydraulic swing cylinders used to swing a boom on a backhoe. Exhausted hydraulic fluid from the hydraulic motor is directed through the control valve to an exhaust line having a back pressure check valve set at a first pressure level. The back pressure check valve maintains a specified amount of hydraulic pressure in the exhaust line adjacent to the control valve as directed by the set pressure level of the valve. The hydraulic motor is provided with a pressure relief valve and an anti-cavitation valve that are mounted in parallel with one another. The anti-cavitation valve is hydraulically coupled to the exhaust line. With a closed center control valve pressurized hydraulic fluid is not continually passing through the exhaust line, as such the back pressure set by the back pressure check valve may be much less than the pressure dictated by this valve. To keep the exhaust line fully charged a second supply line extends between the first supply line and the exhaust line. The second supply line is provided with a pressure reducing valve that is set at a second pressure level. The second pressure level of the pressure reducing valve is less than the first pressure level of the back pressure check valve.

In the preferred embodiment the hydraulic system is a PCLS (Pressure Compensated Load Sensing) system having a variable displacement pump used to supply pressurized hydraulic fluid. The hydraulic motor is a double acting hydraulic cylinder. In addition, the pressure reducing valve can be located in the valve stack for controlling the various operations of a machine.

DETAILED DESCRIPTION

Figure 1:
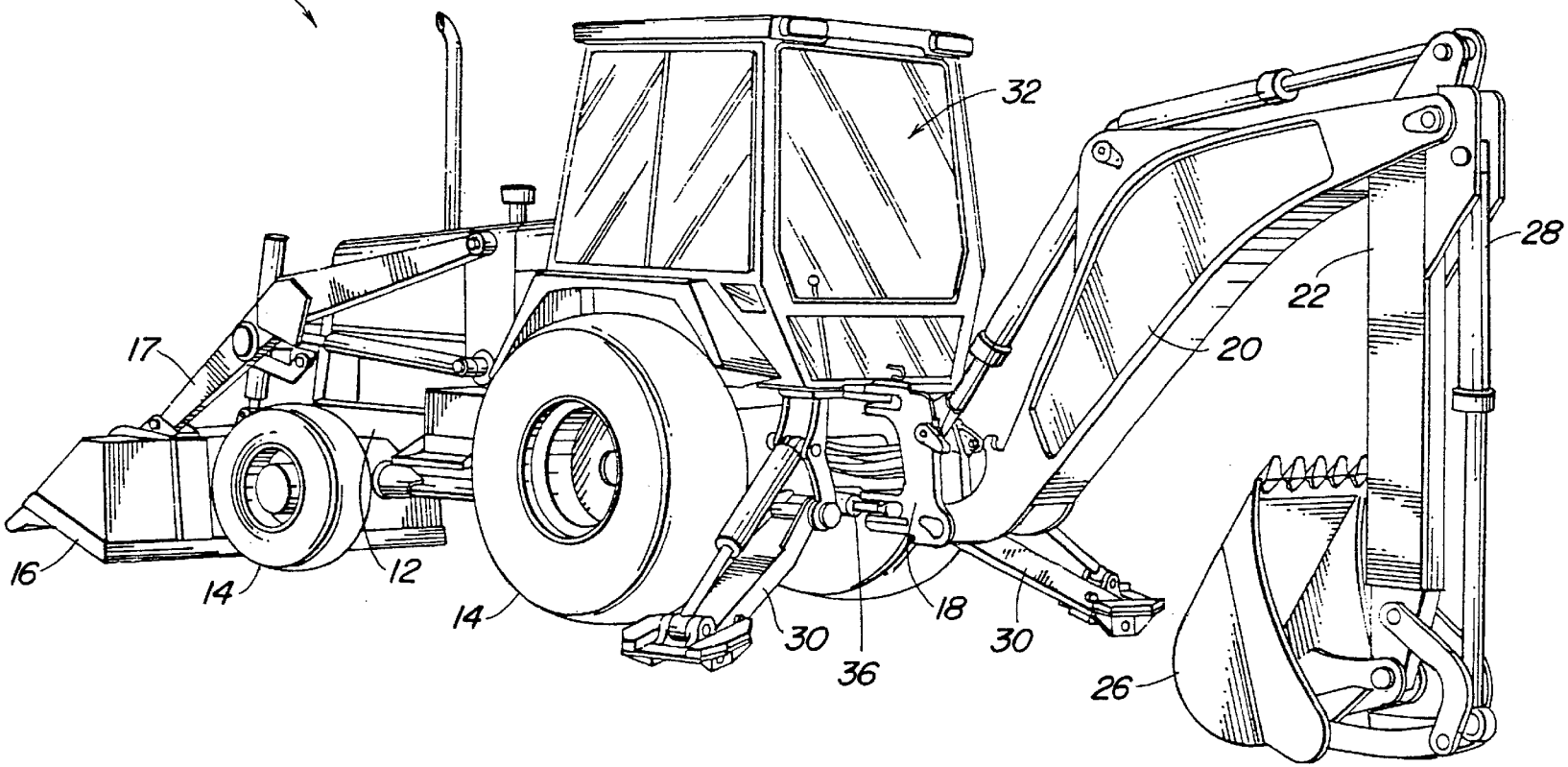
FIG. 1 is a rear perspective view of a self propelled backhoe loader.
Figure 2:
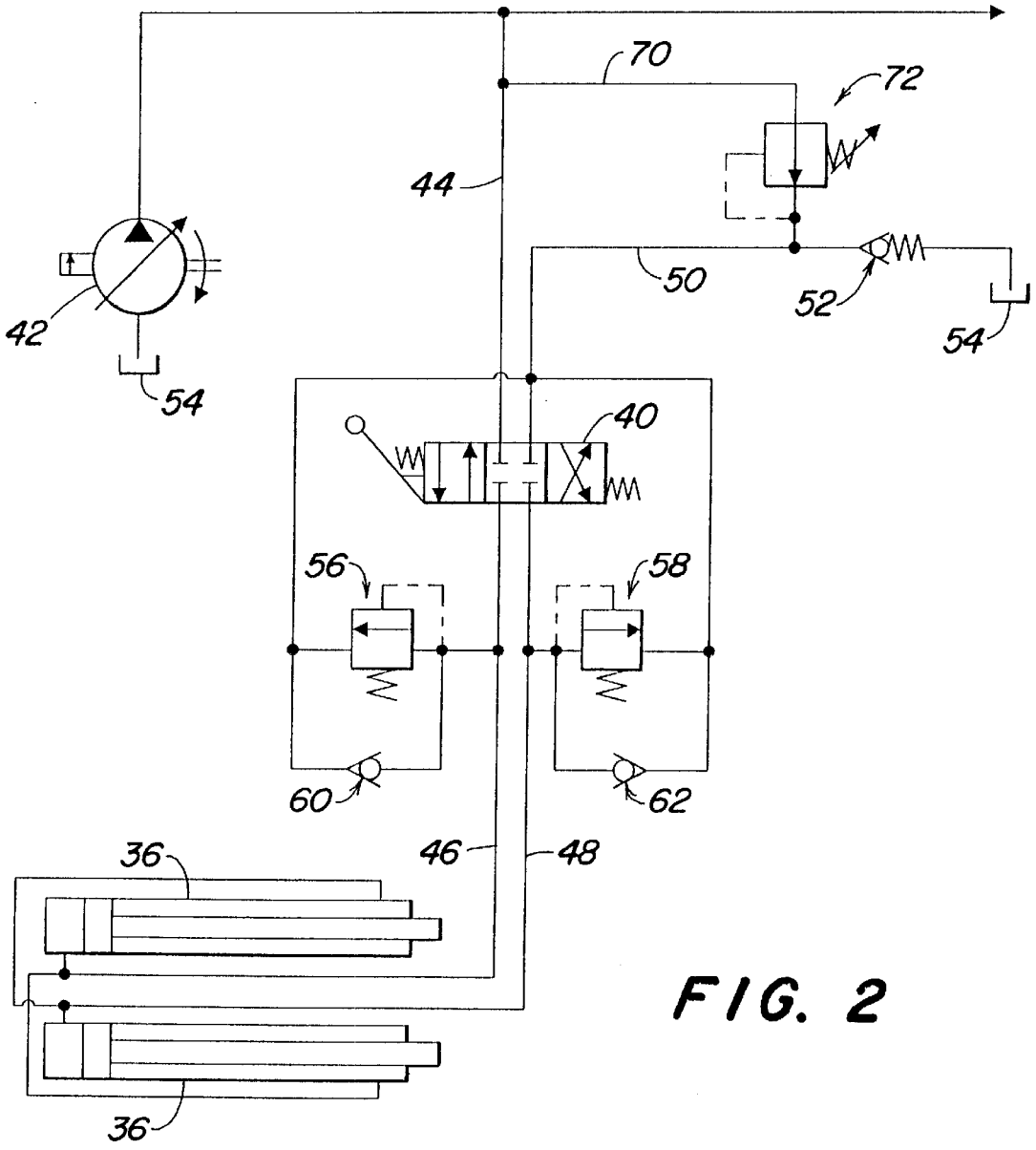
FIG. 2 is a hydraulic schematic of the present inertial load hydraulic dampening system.

FIG. 1 illustrates a backhoe 10, having a supporting frame 12 to which are mounted ground engaging wheels 14 for supporting and propelling the frame. Although the current invention is illustrated as being mounted on a wheeled work vehicle, it can also be mounted on a tracked work vehicle having conventional steel or rubber tracks. The front of the backhoe 10 is provided with a loader bucket 16 having a suitable loader bucket linkage 17 for manipulating the loader bucket relative to the supporting frame 12. The rear of the supporting frame 12 is provided with a swing frame 18. A boom 20 is pivotally coupled to the swing frame 18, a dipperstick 22 is pivotally connected to the boom and a bucket 26 is pivotally connected to the dipperstick 22. A bucket actuating hydraulic cylinder 28 manipulates the bucket 26 through a bucket linkage. The backhoe loader is also provided with two stabilizers 30. The operation of the vehicle is controlled from operator's station 32.

The swing frame 18 is pivotally coupled to the vehicle frame 12 by a vertical pivot in a conventional manner. Hydraulic cylinders 36 pivot the swing frame 18 relative to the supporting frame 12 about a vertical axis defined by the vertical pivot. The position of the swing frame 18 relative to the supporting frame 12 is controlled by a three position control valve 40. The control valve 40 has a right swing position, a left swing position, and a stationary position. Pressurized hydraulic fluid from a source of pressurized hydraulic fluid 42 is coupled to the control valve 40 by supply line 44. In the illustrated embodiment the source of pressurized hydraulic fluid is a variable displacement pump. The control valve 40 in turn is hydraulically coupled to the hydraulic swing cylinders 36 by first and second work lines 46 and 48. Pressurized and exhausted hydraulic fluid passes through the work lines 46 and 48. Exhausted hydraulic fluid from swing cylinders 36 passes through the control valve 40 to exhaust line 50. The exhaust line 50 is provided with a back pressure check valve 52 which has a first pressure level. In one example the back pressure check valve is set at 110 psi (pounds per square inch). If the pressure is less that 110 psi the valve is closed. If the pressure exceeds this first pressure level of 110 psi the valve opens and hydraulic fluid is exhausted through an oil cooler, not shown, back to tank 54 where it is returned to the pump 42.

Each of the swing cylinders 36 are also provided with a pressure relief valve 56 and 58 and an anti-cavitation valve 60 and 62. The pressure relief valve 56 is coupled in parallel with anti-cavitation valve 60. Both of these valves 56 and 60 are hydraulically positioned between work line 46 and exhaust line 50. Similarly, the pressure relief valve 58 is coupled in parallel with anti-cavitation valve 62. Again, both of these valves are hydraulically positioned between work line 48 and exhaust line 50.

The above discussed swing cylinder hydraulic configuration is typical of the prior art for a backhoe having a PCLS hydraulic system. The present invention is different from the prior art in providing a second supply line 70 and a pressure reducing valve 72. The second supply line 70 extends between the first supply line 44 and the exhaust line 50. The flow of pressurized hydraulic fluid through this short circuit path is controlled by pressure reducing valve 72 that is hydraulically positioned in the second supply line 70 and which is set at a second pressure level that is less than the first pressure level of the back pressure check valve 52. In the example discussed above the pressure reducing valve 72 is set at 100 psi which is 10 pounds less than the 110 psi setting of the back pressure check valve 52. In this way the exhaust line 50 between the back pressure check valve 52 and the control valve 40 is maintained at a minimum pressure of 100 psi and at a maximum maintained pressure of 110 psi. Therefore, the back pressure on the anti-cavitation valves 60 and 62 is at the same pressure level in the exhaust line 50, and additional fluid from the exhaust line 50 can be supplied to the cavitating side of a hydraulic cylinder 36. By supplying the fluid to the cavitating side in a rapid manner the oscillation is dampened when stopping a large body abruptly.

The invention should not be limited to the above described embodiment, but should be limited solely to the claims that follow.

I claim:

1. A backhoe comprising:

a supporting frame;

a swing frame pivotally mounted to the supporting frame about a vertical pivot;

a boom pivotally mounted to the swing frame;

a dipperstick pivotally mounted to the boom;

a work implement pivotally mounted to the dipperstick;

a hydraulic swing cylinder extends between the supporting frame and the swing frame for pivoting the swing frame about the vertical pivot;

a hydraulic circuit is hydraulically coupled to the hydraulic swing cylinder and comprises a source of pressurized hydraulic fluid, pressurized hydraulic fluid from the source of pressurized hydraulic fluid is directed through a first supply line to a swing control valve, from the swing control valve pressurized hydraulic fluid and exhausted hydraulic fluid is directed to and from the hydraulic cylinder through a work line, exhausted hydraulic fluid is directed by the swing control valve to the source of pressurized hydraulic fluid through an exhaust line having a back pressure check valve set at a first pressure level, an anti-cavitation valve is hydraulically positioned between the exhaust line and the work line, a second supply line extends between the first supply line and the exhaust line, a pressure reducing valve is hydraulically positioned in the second supply line and is set at a second pressure level, whereby the second pressure level is less than the first pressure level.

2. A backhoe as defined by claim 1 wherein the source of pressured hydraulic fluid is a pump.

3. A backhoe as defined by claim 2 wherein the swing control valve is a closed center valve.

4. A backhoe as defined by claim 3 wherein a pressure relief valve is hydraulically mounted in parallel with the anti-cavitation valve.

5. A backhoe as defined by claim 4 wherein the hydraulic swing cylinder is a double acting hydraulic cylinder.

6. A backhoe as defined by claim 5 wherein a second hydraulic swing cylinder swings the swing frame in conjunction with the hydraulic swing cylinder, the second hydraulic swing cylinder is also a double acting hydraulic cylinder, as such there is a second work line extending between the swing control valve and the second hydraulic swing cylinder, a second anti-cavitation valve that is hydraulically positioned between the second work line and the exhaust line, and a second pressure relief valve is mounted in parallel with the second anti-cavitation valve.

7. A backhoe as defined by claim 6 further comprising ground engaging means extending from the supporting frame means for supporting and propelling the supporting frame.

8. A backhoe as defied by claim 7 wherein the supporting frame is provided with an operators station for controlling the operation of the backhoe.

9. A backhoe as defined by claim 8 wherein the swing frame and boom is located at the rear of the supporting structure and a loader bucket and associated loader linkage is located at the front of the supporting frame.

10. A backhoe as defined by claim 9 wherein the work implement is a bucket.

11. A hydraulic system for dampening the high inertia forces generated by a body being driven by a hydraulic motor, the system comprising:

a source of pressurized hydraulic fluid;

a first supply line is coupled to the source of pressurized hydraulic fluid;

a control valve is coupled to the first supply line;

a work line extends from the control valve to the hydraulic motor;

an exhaust line is coupled to the control valve and returns exhausted hydraulic fluid to the source of pressurized hydraulic fluid;

a back pressure check valve set at a first pressure level is hydraulically located in the exhaust line;

an anti-cavitation valve is hydraulically positioned between the exhaust line and the work line;

a second supply line extends between the first supply line and the exhaust line;

a pressure reducing valve is hydraulically located in the second supply line and is set at a second pressure level, whereby the second pressure level is less than the first pressure level.

12. A hydraulic system as defined by claim 11 wherein the source of pressurized hydraulic fluid is a pump.

13. A hydraulic system as defined by claim 12 wherein the control valve is a closed center valve.

14. A hydraulic system as defined by claim 13 wherein a pressure relief valve is hydraulically mounted in parallel with the anti-cavitation valve.

15. A hydraulic system as defined by claim 14 wherein the hydraulic motor is a double acting hydraulic cylinder.

16. A hydraulic system as defined by claim 15 wherein the pump is a variable displacement pump.

* * * * *